US005656001A

United States Patent [19]

Baatz

[11] Patent Number: 5,656,001

[45] Date of Patent: Aug. 12, 1997

[54] EDDY CURRENT TRAINER FOR BICYCLES OR OTHER EXERCISE EQUIPMENT

[75] Inventor: Wilfried Baatz, Seattle, Wash.

[73] Assignee: Racer-Mate, Inc., Seattle, Wash.

[21] Appl. No.: 601,131

[22] Filed: Feb. 14, 1996

Related U.S. Application Data

[63] Continuation-in-part of Ser. No. 507,906, Jun. 28, 1995.

[51] Int. Cl.[6] ..... A63B 69/16; A63B 21/005

[52] U.S. Cl. ..... 482/61; 482/63; 482/903

[58] Field of Search ..... 482/57, 6, 61, 482/63, 903

[56] References Cited

U.S. PATENT DOCUMENTS

| | | | |
|---|---|---|---|
| Re. 34,479 | 12/1993 | Minoara | 482/61 |
| 351,311 | 10/1886 | Conkling . | |
| 418,933 | 1/1890 | Sommerville . | |
| 574,167 | 12/1896 | Ray . | |
| 645,482 | 3/1900 | Mills . | |
| 1,653,921 | 12/1927 | Mullen, Jr. . | |
| 2,788,211 | 4/1957 | Ivanoff . | |
| 3,589,193 | 6/1971 | Thornton | 482/57 |
| 4,082,264 | 4/1978 | Santos . | |
| 4,084,810 | 4/1978 | Forsman . | |
| 4,505,473 | 3/1985 | Pro . | |
| 4,674,742 | 6/1987 | Baatz . | |
| 4,752,066 | 6/1988 | Housayama . | |
| 4,826,150 | 5/1989 | Minoura . | |
| 4,838,544 | 6/1989 | Sasakawa et al. . | |
| 4,898,379 | 2/1990 | Shiba | 482/61 |
| 5,031,900 | 7/1991 | Leask . | |
| 5,051,638 | 9/1991 | Pyles . | |
| 5,254,061 | 10/1993 | Leask | 482/63 |

OTHER PUBLICATIONS

Miscellaneous Brochure, "Racer–Mate".

Miscellaneous Brochure, "The Hits of the '78 Shows," JCII Bicycle Products.

Miscellaneous Brochure, "Make Fitness A Year–Round Thing," Troxell Manufacturing Company.

Miscellaneous Brochure, "Home–Trainer F.T.G.," *Fitness Zu Hause*.

Assembly Manual, "Assembly and Installation Instruction," *Racer–Mate*, Jul. 1978.

Assembly Manual, "Assembly and Installation Instruction," *Racer–Mate III*, Jul. 1984.

Assembly Manual, "Assembly and Installation Instruction," *Racer–Mate*, Aug. 1985.

Operating Manual, "Compu Trainer, Computerized Training System," *Racer–Mate*, 1994.

*Primary Examiner*—Stephen R. Crow

*Attorney, Agent, or Firm*—Christensen O'Connor Johnson & Kindness PLLC

[57] ABSTRACT

An eddy current brake for use with exercise training devices, such as bicycle, ski and rowing exercise devices. The eddy current brake includes a nonmagnetic, electrically conductive disk that is rotatably mounted between one or more electromagnets. The electromagnets introduce eddy currents within the rotating disk. The disk is formed of a copper alloy having between approximately 5.0% to 15.0% zinc by weight. In one embodiment of the invention, the disk is formed of copper alloy 220, comprising 90.0% copper and 10.0% zinc.

3 Claims, 5 Drawing Sheets

50
50
46
44
48
54
63
84
62
85
72
64
70
74
81
66
26
80
52

EDDY CURRENT TRAINER FOR BICYCLES OR OTHER EXERCISE EQUIPMENT

RELATED APPLICATIONS

This is a continuation-in-part of the prior U.S. patent application Ser. No. 08/507,906, filed Jun. 28, 1995, entitled EDDY CURRENT TRAINER FOR BICYCLES OR OTHER EXERCISE EQUIPMENT, the benefit of the filing date of which is hereby claimed under 35 U.S.C. §120.

FIELD OF THE INVENTION

The present invention relates to in-place exercise devices or trainers for bicycles, rowing machines, and ski machines, and more specifically to eddy current load simulators for bicycle trainers or other exercise equipment.

BACKGROUND OF THE INVENTION

Three primary types of bicycle trainers or exercise devices are known in the prior art. In "roller" type trainers, the rear wheel of a two-wheeled bicycle is supported on two parallel rollers. As a user pedals, the rear wheel rotates, causing the rollers to rotate. The rolling friction of the bicycle tire against the rollers simulates the actual rolling resistance that a bicycle rider would have to overcome while peddling the bicycle at the same speed on a level road. Such bicycle trainers cannot simulate wind resistance or resistance caused by varying terrain.

A second type of trainer that overcomes some of the limitations of "roller" type trainers is commonly known as a "wind trainer." Wind trainers include a fan assembly that is placed in rotational contact with the rear wheel of a bicycle. As the rear wheel rotates, the fan assembly rotates and generates a load that is proportional to the load that would be produced by wind resistance if the pedalist were actually riding the bike on the road at the same speed. Most wind trainers include a frame in which to mount the bicycle such that the fan assembly is positioned beneath the rear wheel of the bicycle and is frictionally engaged by the rear wheel.

Although wind trainers represent a significant improvement in bicycle training devices, they have a number of limitations. Wind trainers provide increasing resistance to the bicyclist as the rear wheel, and thus fan assembly, rotate at increasing speeds. However, wind trainers do not simulate the varying resistances produced during actual riding over varying terrain, up or down hills, etc.

To improve upon prior roller-type trainers and wind trainers, a third type of training device has achieved widespread use during the past several years. This new class of trainers, termed "eddy current" trainers, include an eddy current brake that is rotationally coupled to the rear wheel of the bicycle. The eddy current brake includes a shaft that is placed in rotational contact with the rear wheel of the bicycle. As the rear wheel of the bicycle rotates, it rotationally drives the shaft.

In one prior eddy current brake, a plurality of permanent magnets are arranged on both sides of the conductive disk. As the disk rotates, the permanent magnet's magnetic fields induce eddy currents within the rotating disk. The eddy currents in turn produce electromagnetic fields that interact with the permanent magnet's magnetic fields. This interaction of electromagnetic fields produces a resistance to the rotation of the disk, and thus the shaft and rear wheel of the bicycle. The amount of torque produced by the eddy current brake is influenced by a number of factors, including the size and shape of the permanent magnets, the placement of the permanent magnets around the rotating disk, the size and thickness of the rotating disk, the material out of which the rotating disk is formed, the spacing between the disk and magnets, and the speed at which the disk rotates, to name a few.

The faster the bicyclist pedals, the faster the resulting rotation of the rear wheel and disk, and thus the greater resistance produced by the eddy current brake. In some eddy current type trainers, the bicyclist cannot alter the configuration of the eddy current brake. In these trainers, the resistance changes as a function of the rate at which the rear wheel of the bicycle rotates. Such eddy current trainers are not capable of simulating actual bicycling conditions, such as changing elevations due to hills, etc.

Other eddy current trainers allow the bicyclist to alter the configuration of the permanent magnets during use. This type of trainer thus gives the bicyclist a means in addition to changing the rate at which the rear wheel rotates for altering the resistance of the eddy current brake. However, such trainers are still highly limited in their ability to simulate the wide range of resistances experienced during bicycling on the open road.

A more recent improvement upon eddy current trainers is the incorporation of eddy current brakes that use electromagnets, as opposed to permanent magnets. The use of electromagnets allows individual or groups of magnets to be energized at specified times and voltages to produce variable torques, and resistances to the rotation of the bicycle's rear wheel. The use of electromagnets allows the resistance or braking force to be set to any desired level or varied in order to duplicate actual road conditions experienced by a bicycle rider. Trainers incorporating such eddy current brakes can take into account wind resistance, head winds, changes in elevation, rider inertia, rolling resistance, the effects of drafting, etc. An eddy current trainer that uses electromagnets to simulate real life bicycling road conditions is sold under the trademark COMPUTRAINER® by Racermate, located at 3016 N.E. Blakely Street, Seattle, Wash. 98105.

Although the use of electromagnets in eddy current bicycle trainers has dramatically improved the trainers, there are still some limitations. During use in high-end or professional applications, it has been discovered that certain factors may cause unwanted variations in the torque and resistance produced by eddy current bicycle trainers varies during use. For example, temperature changes in the eddy current disks have been shown to cause variations in the torque and resistance. The load or resistance produced by the eddy current trainer is one of the variables used to measure the energy expended, and thus physical performance of the user. It is important, particularly in professional athletic training, to obtain an accurate measurement of the athlete's energy output in order to identify areas in need of improvement. However, in past eddy current trainers, the torque, and thus measured athlete's energy output, may change between measurements, even if the athlete's output actually remains constant. Thus, it is not currently possible to use eddy current trainers to obtain highly accurate measurements of an athlete's performance.

As can be seen from the above, there exists a need for eddy current exercise trainers that produce accurate and consistent torque/resistance measurements during sustained use. The present invention is an improved eddy current exercise trainer directed to fulfilling this need.

SUMMARY OF THE INVENTION

The present invention is an eddy current brake for use with exercise training devices, including bicycle, ski, and rowing exercise training devices. The eddy current brake includes a disk rotatably mounted between one or more permanent magnets or electromagnets. The magnets are positioned adjacent the disk and introduce eddy currents in the disk when the disk is rotating. The disk is formed of a nonmagnetic, electrically conductive copper alloy having between approximately 5.0% to 15.0% zinc by weight. In the preferred embodiment, the disk is formed of copper alloy 220 having 90% copper and 10% zinc by weight.

In one embodiment of the invention, the eddy current brake is incorporated in an exercise training device for use with a bicycle having a rear wheel rotatably mounted on a rear axle. The training device includes a frame for supporting the bicycle in the upright position. The eddy current brake is coupled to the frame in order to contact the rear wheel of the bicycle when the bicycle is mounted within the frame. The nonmagnetic electrically conductive disk is rotatably coupled to the rear wheel so that it rotates along with the rear wheel.

In another embodiment of the invention, the eddy current brake is incorporated into a rowing-type exercise training device. The rowing exercise device includes a frame, a seat slidably connected to the frame, a flywheel rotatably coupled to the frame and an eddy current brake connected to the flywheel. As the flywheel rotates, it rotates the nonmagnetic, electrically conductive disk in the eddy current brake.

In yet another embodiment of the invention, a ski training exercise device incorporates the eddy current brake. The ski training device includes a frame and two elongate ski members slidably coupled to the frame. The eddy current brake is coupled to the ski members such that longitudinal motion of the ski members rotates the nonmagnetic, electrically conductive disk in the eddy current brake.

Exercise training devices incorporating an eddy current brake according to the present invention have a number of advantages over past eddy current exercise devices. The invention's use of a disk formed of a copper alloy having between approximately 5.0% to 15.0% zinc by weight decreases variations in measured performance caused by temperature fluctuations, over similar devices using disks formed of other materials.

As an eddy current brake is operated, the temperature of the rotating disk increases. The resistivity of the material from which the disk is formed changes as a function of the temperature of the disk. Therefore, the torque/resistance characteristics of the eddy current brake change as a function of the temperature of the disk. Not only does the resistivity of prior eddy current disks change as a function of temperature, these changes are not consistent during subsequent uses of the eddy current brake. Often, the operating temperature of the eddy current disks are sufficient to change the temper of the material from which the disk is formed. Such changes in the material's temper also change the resistivity of the disk.

As the torque/resistance characteristics of the eddy current brake change, errors are produced in the measured performance of an athlete using the exercise training device. Such errors can exceed 10% in exercise training devices used by competitive athletes. Such errors prevent eddy current exercise training devices from being used to obtain an accurate indication of an athlete's performance.

Exercise training devices incorporating a disk formed of a copper alloy having between approximately 5.0% to 15.0% zinc by weight increases the accuracy of the equipment over similar prior art devices. This improved accuracy allows a user to obtain a more accurate indication of performance.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
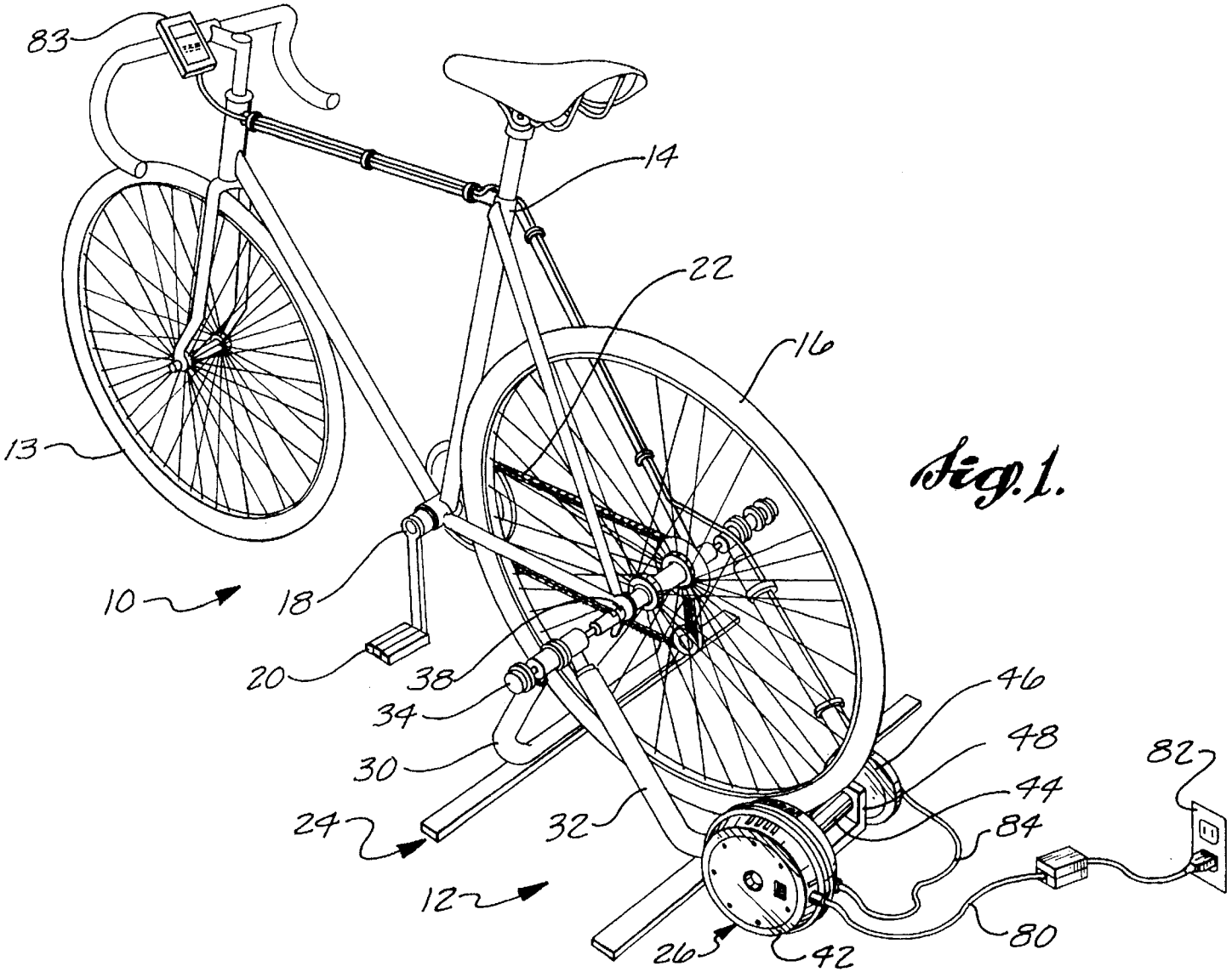
FIG. 1 is a perspective view of a bicycle mounted in an eddy current exercise training device according to the present invention.

FIG. 1 illustrates a bicycle 10 mounted in an exercise training device 12 according to the present invention. The bicycle 10 includes a front wheel 13, a frame 14 and a rear wheel 16. The rear wheel 16 is rotatably mounted at the rear end of the frame 14 at pivot 38. The rear wheel 16 is rotatably coupled to a drive spindle 18 and pedals 20 by a continuous chain 22 in a manner well known in the art.

The training device 12 includes a frame 24, an eddy current brake 26, a shaft 44 and a flywheel 46. The frame 24 is formed of a U-shaped forward frame member 30 and a U-shaped rear frame member 32. The ends of the frame members 30 and 32 are pivotally joined at a pivot 34. The forward and rear U-shaped frame members 30 and 32 rotate with respect to each other around pivot 34. This rotational movement allows the frame 24 to be moved between a collapsed position (not shown) and an extended position (FIG. 1). In the collapsed position, the forward and rear frame members 30 and 32 lie adjacent to each other while in the extended position or the forward and rear members form an upside-down V, as illustrated in FIG. 1.

The rear end of the frame 14 of the bicycle 10 is mounted within the frame 24 of the exercise training device 12 at the pivot point 34. When placed in the frame 24, the pivot 38 of the rear wheel 16 is attached to the frame 24 and is aligned with the pivot 34.

The eddy current brake 26 is mounted on the lower crossbar of the rear U-shaped frame member 32. The eddy current brake 26 includes a housing 42 (FIG. 1) in which the mechanics and electronics for the eddy current brake are located, the rotatably mounted shaft 44, the flywheel 46, and a U-shaped support bracket 48.

The shaft 44 is rotatably mounted within opposing bearings 50 (FIG. 2) in the arms of the support bracket 48. The support bracket 48 is, in turn, attached to the rear U-shaped frame member 32 so that the rear wheel 16 contacts the shaft 44 and causes the shaft to rotate as the wheel rotates. The housing 42 is mounted on one of the arms of the support bracket 48. The flywheel 46 is mounted on the shaft 44 adjacent the other arm of the support bracket 48.

Figure 2:
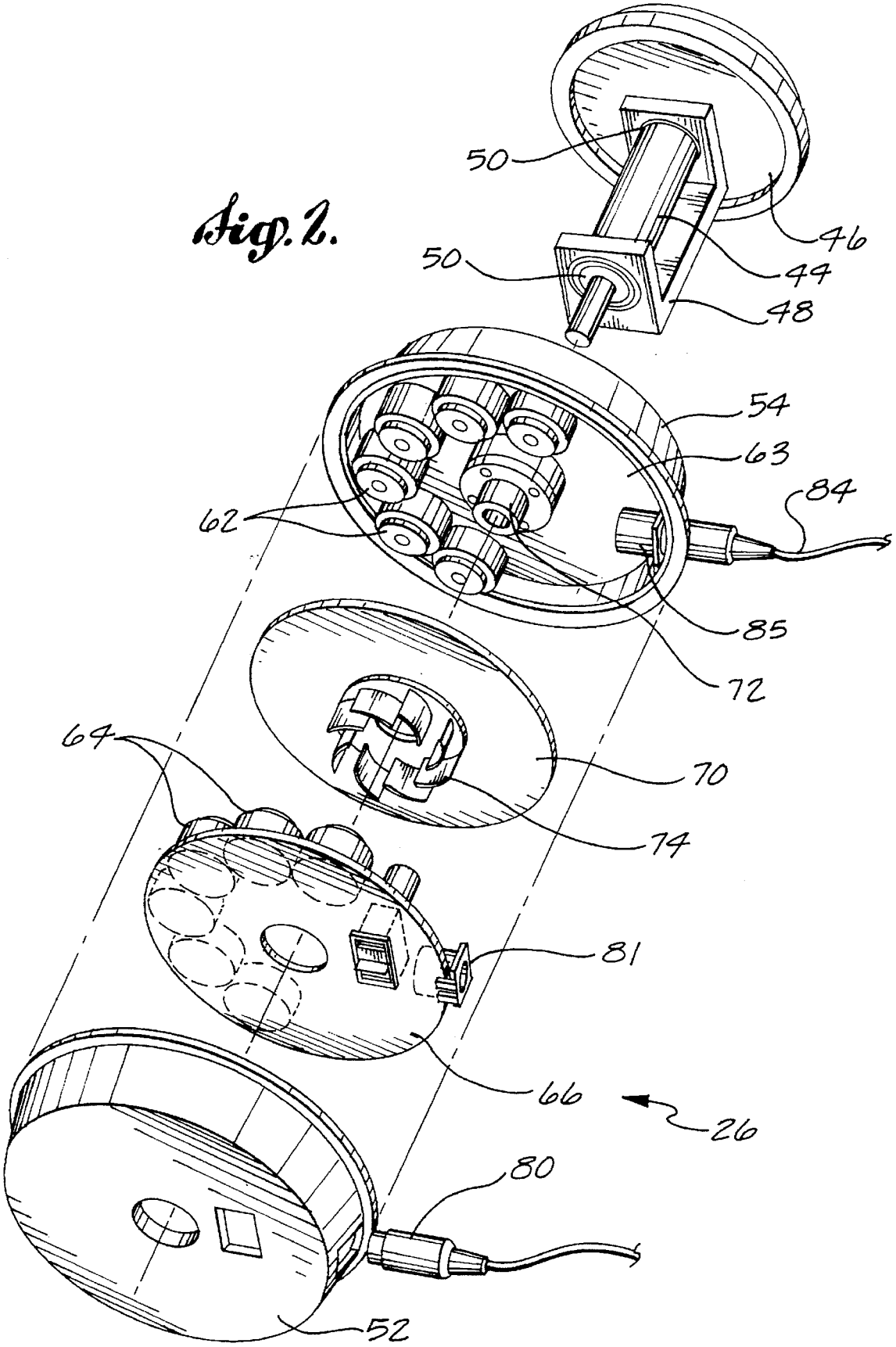
FIG. 2 is a partially exploded view of the eddy current brake of the exercise training device of FIG. 1.

As illustrated in FIG. 2, the housing 42 (FIG. 1) is formed of an outer cylindrical housing 52 that is joined to a correspondingly-sized inner cylindrical housing 54 by bonding, fasteners, etc. The left-hand end (FIG. 2) of the shaft 44 extends through the inner housing 54 into the interior of the housing 42. In the preferred embodiment, six cylindrical electromagnets 62 are mounted on a supporting circuit board disk 63 attached to the inner surface of the inner housing 54. The electromagnets 62 are distributed around the circumference of the disk 63, and thus around the portion of the shaft 44 extending into the housing 42. An opposing set of six electromagnets 64 is mounted on a supporting circuit board 66 attached to the inner surface of the outer housing 52. The electromagnets 64 are mounted directly opposite the corresponding electromagnets 62.

A nonmagnetic, electrically conductive circular disk 70 (FIG. 2) is mounted on the shaft 44 so that it rotates along with the shaft. The circular disk 70 is mounted on the shaft 44 between the opposing sets of electromagnets 62 and 64. The disk 70 is supported on the shaft 44 by a cylindrical support bracket 72 on one side and by a cylindrical fan 74 on the other side (FIG. 2). The fan 74 includes a plurality of fan blades that extends outward from the surface opposite the disk 70. As the shaft 44, and thus disk 70, and fan 74 rotate, the fan produces a flow of air that cools the disk 70 and the electromagnets 62 and 64, disk 70, and electronics (not shown) used to regulate the flow of power to the electromagnets.

The opposing sets of electromagnets 62 and 64 are connected to an electrical drive circuit (not shown) located on the supporting circuit boards 63 and 66. The electrical drive circuit is in turn connected to a power source by an electrical cable 80. The cable 80 plugs into a female connection 81 on the circuit board 66 on one end and into a wall outlet 82 (FIG. 1) on the other end. The electrical drive circuit is also connected to a control panel 83 (FIG. 1) by an electrical cable 84. The electrical cable 84 plugs into a female connector 85 on the circuit board 63 on one end and into the control panel 83 on the other end. The electrical drive circuit energizes the electromagnets 62 and 64 at predetermined times and power levels to produce magnetic fields between the opposing sets of magnets 62 and 64.

As a bicyclist pedals, the eddy current disk 70 rotates within the magnetic fields produced by the electromagnets 62 and 64. The eddy current disk 70 is formed of a nonmagnetic, electrically conductive material. Therefore, the magnetic fields produced by electromagnets 62 and 64 produce eddy currents, and thus electromagnetic fields within the structure of the disk 70 as it rotates. The interaction between the electromagnetic fields produced by the eddy currents within the disk 70 and the magnetic fields produced by the electromagnets 62 and 64 creates a torque/resistance to the rotation of the shaft 44, and thus rear wheel 16.

The structure and operation of the electrical drive circuit and electromagnets 62 and 64 are well known to those of ordinary skill in the art. It would be readily understood by one of ordinary skill in the art how to construct an appropriate electrical drive circuit and opposing sets of electromagnets 62 and 64.

Although the present invention utilizes opposing sets of six electromagnets 62 and 64, alternate embodiments of the invention could use other numbers of magnets. The magnitude of the resistance/torque produced by the eddy current brake 26 depends upon a number of variables including the RPM at which the disk 70 is rotated, the diameter and thickness of the disk, the material from which the disk is formed, the spacing between the disk 70 and the electromagnets 62 and 64, and the strength of the magnetic fields produced by the electromagnets, to name just a few of the variables.

The torque/resistance produced by the eddy current brake 26 may be increased or decreased in order to simulate changes in terrain. For example, the electrical control circuit may be used to adjust the power energizing the electromagnets 62, thus adjusting the amount of torque/resistance produced by the eddy current brake 26.

Bicycle training devices having eddy current brakes based on controlled power electromagnets are commercially available and sold under the trademark COMPUTRAINER® by Racermate, located at 3016 N.E. Blakely Street, Seattle, Wash. 98105. Such training devices include a programmable control panel that allows realistic terrain to be simulated, including hills, valleys, etc.

In prior bicycle training devices of the type described above, the eddy current disk 70 has been formed of an aluminum alloy. The resistivity of aluminum alloys changes as a function of temperature. When an eddy current brake 26, having a disk 70 formed of an aluminum alloy is used at high RPM, the disk heats up to sufficient temperatures to change the resistivity of the disk. As the resistivity of the disk changes, the torque/resistance produced by the eddy current also changes. The change in torque/resistance as a function of temperature results in inaccurate measurements of the user's energy output and thus, performance. If the disk 70 is subjected to sufficient temperatures, the temper of the aluminum alloy can also change. Such changes in the disk's temper also change the resistivity and thus performance of the disk.

In accordance with the present invention, the disk 70 used in the eddy current brake 26 is formed of a copper alloy having an added element of zinc. It has been found advantageous to form the disk 70 of a copper alloy containing between approximately 5.0% to 15.0% zinc by weight. In the preferred embodiment, the disk 70 is formed of a copper alloy 220 that includes 90.0% copper and 10.0% zinc. Copper alloy 220 is commercially available and sold under the term "commercial bronze." In alternate embodiments of the invention, copper alloy 230, comprising 85.0% copper and 15.0% zinc, commonly referred to as "red bronze," could also be used.

Figure 5:
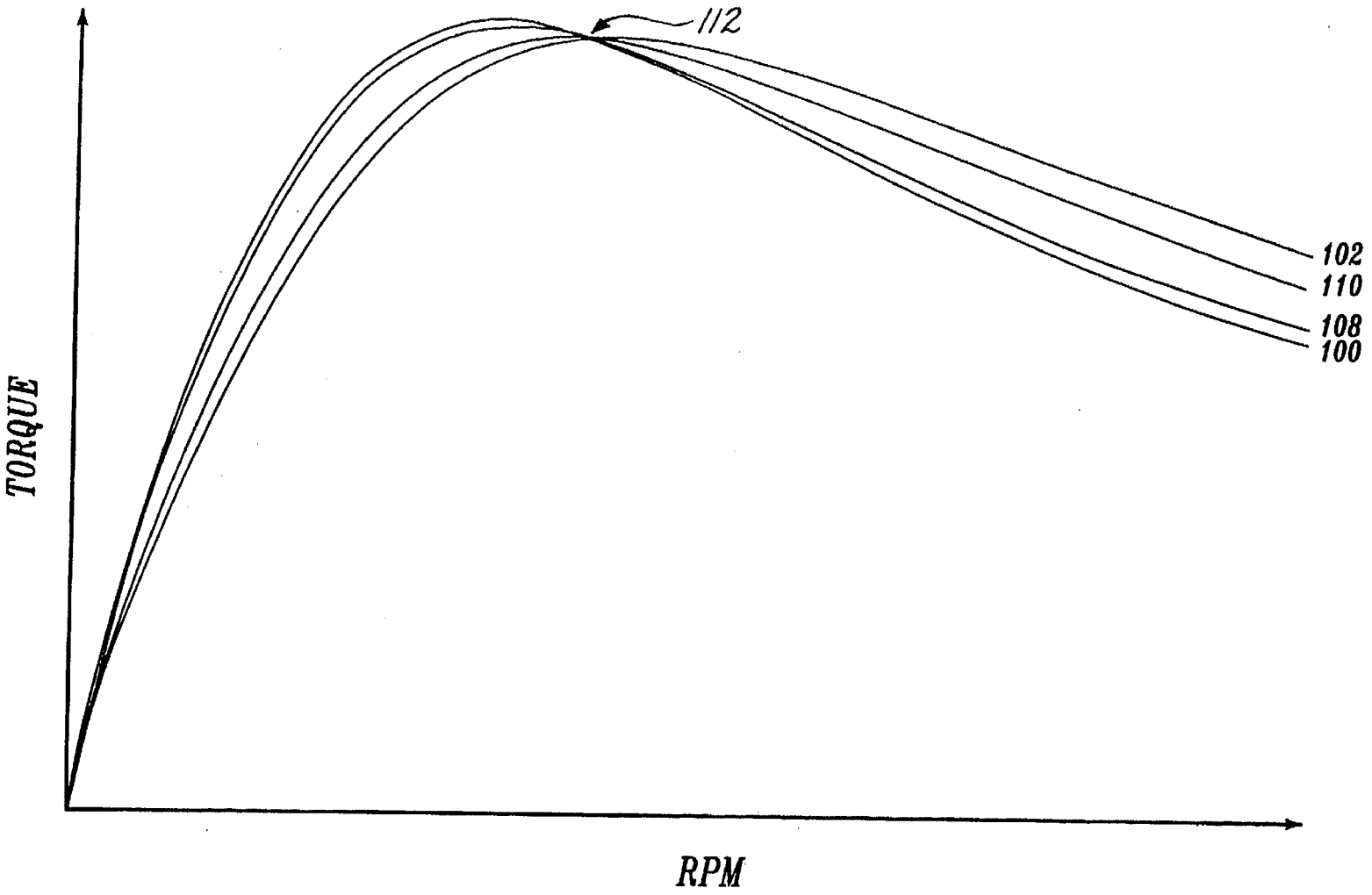
FIG. 5 is a graph of the performance of an eddy current brake including disks formed of different materials, wherein RPM is plotted along the x-axis, and torque is plotted along the y-axis.

The advantages of using a disk 70 formed of a copper alloy in accordance with the present invention will now be described by reference to FIG. 5. FIG. 5 is a representative graph showing a comparison between an eddy current brake incorporating a disk formed of a copper alloy in accordance with the invention and a similar eddy current brake incorporating a disk 70 formed of an aluminum alloy 1050. In FIG. 5, the RPM at which a representative disk is rotated is nondimensionally plotted along the x-axis, while nondimensional torque produced by the eddy current brake is plotted along the y-axis. The two disks which are being compared in FIG. 5 are made of aluminum alloy 1050 and copper alloy 220. Line 100 is a plot of the torque produced using a disk 70 formed of aluminum alloy 1050 operating at room temperature. Line 102 is a plot of the torque produced by the same aluminum disk operating at an elevated temperature. Line 108 is a plot of the torque produced by a disk formed of copper alloy 220 (90.0% copper 10.0% zinc) operating at room temperature. Line 110 is a plot of the torque produced by the copper alloy 220 disk operating at an elevated temperature.

As illustrated by lines 108 and 110 in FIG. 5, the relative difference in torque between the results at room temperature and at an elevated temperature for the disk 70 formed of copper alloy 220 is significantly less than that for the disk formed of aluminum alloy 1050.

The present invention's use of a disk 70 formed of a copper alloy having between approximately 5.0% to 15.0% zinc by weight results in unexpected and unknown improved performance over prior exercise training devices. These unexpected improvements in performance produce a more accurate exercise training device 12. The preferred embodiment of the exercise training device 12 increases the accuracy of the measured performance over prior versions using an aluminum disk.

Figure 3:
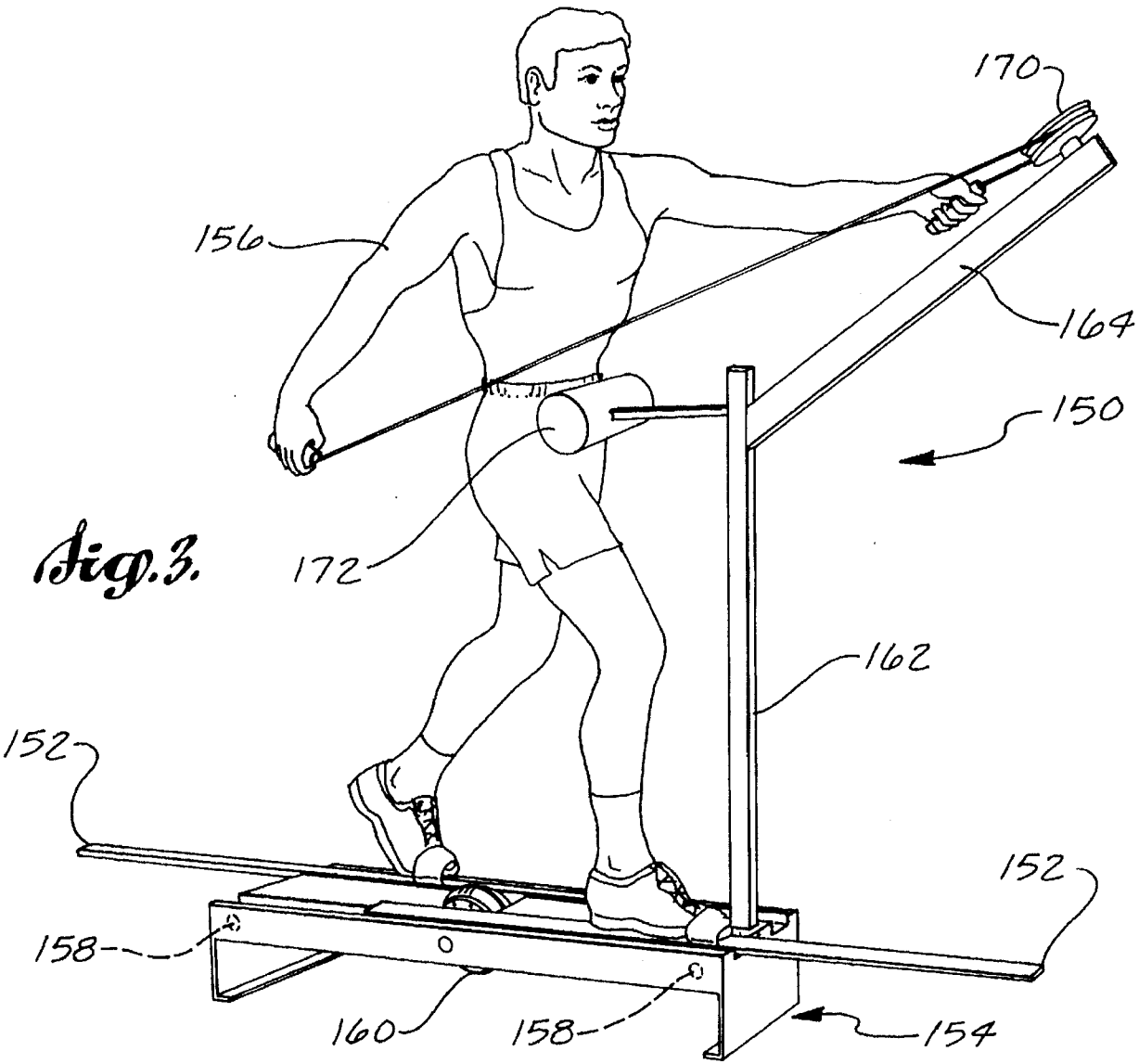
FIG. 3 is a perspective view of a ski training exercise device having an eddy current brake according to the present invention.
Figure 4:
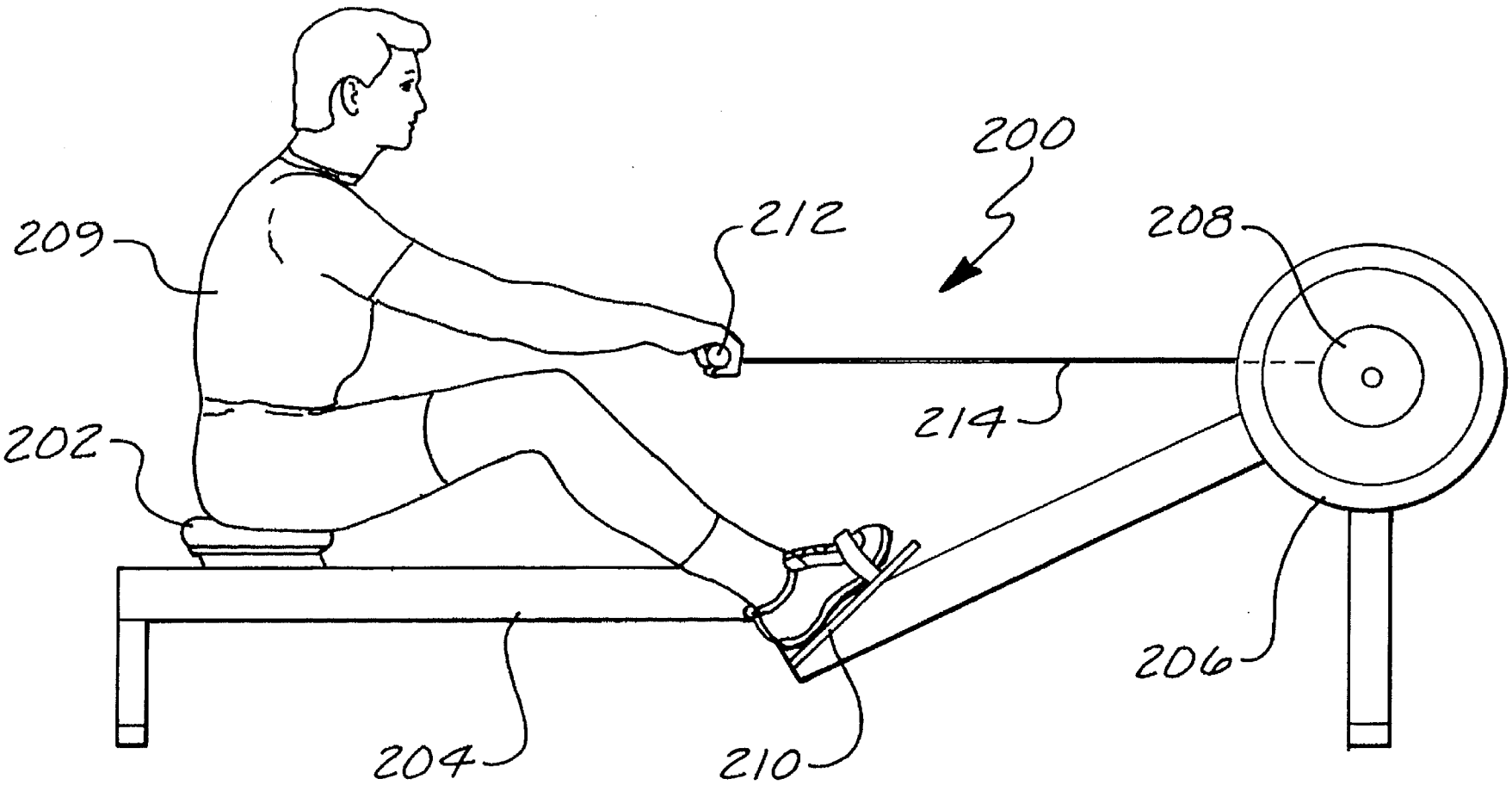
FIG. 4 is a perspective view of a rowing exercise training device having an eddy current brake according to the present invention.

An eddy current brake according to the present invention may also be incorporated into other types of exercise devices. For example, the eddy current brake of the invention could be used with a dedicated bicycle exercise trainer. FIGS. 3 and 4 illustrate the use of the invention in a ski-type exercise machine and a rowing-type exercise machine, respectively.

As illustrated in FIG. 3, the ski-type exercise machine 150 includes two parallel elongate ski members 152 slidably mounted within a frame 154. An upright support 162 extends upward from the forward edge of the frame 154 and includes a diagonal cross-member 164 that extends upward and forward from the support member 162. The exercise machine 150 also includes a rotatably mounted hand exercise device 170 mounted at the upper end of the diagonal support member 164 and a waist support 172 that extends rearward from the support 162.

The elongate ski members 152 may be moved longitudinally back and forth by the user 156 so that the ski members remain parallel to each other and simulate cross-country skiing. Each ski member 152 is supported at the opposing ends of the frame 154 by rotatably mounted bearings or rollers 158.

An eddy current brake 160 according to the invention is mounted in the frame approximately centered between the two rollers 158. The shaft of the eddy current brake contacts the lower surface of the elongate ski members 152. In a manner well known in the art, the shaft of the eddy current brake includes clutches that allow the eddy current brake to rotate in response to rearward movement of either of the skis 152, but prevent forward movement of the skis 152 from influencing the rotation of the shaft.

The structure and operation of the eddy current brake 160 is similar to that of the eddy current brake 26 described above with respect to the bicycle trainer embodiment of the invention. The structure and operation of the eddy current brake 160 may be understood by reference to the discussion of the eddy current brake 26 above.

As the disk within the eddy current brake 160 rotates, a torque or resistance to the movement of the elongate ski members 152 is produced in a manner similar to that described above with respect to the bicycle trainer embodiment of the invention. Also in a manner similar to that described above, the electromagnets within the eddy current brake 160 may be selectively energized by a control circuit (not shown) to produce varying torques and resistances to the motion of the elongate ski members.

In accordance with the invention, the disk within the eddy current brake 160 is formed of a copper alloy having between approximately 5.0% and 15.0% zinc by weight. In the preferred embodiment, the disk is formed of copper alloy 220 having approximately 90.0% copper and 10.0% zinc.

FIG. 4 illustrates a rowing exercise training device 200 according to the present invention. The exercise device 200 includes a seat 202 that is slidably mounted upon an elongate frame 204. The seat 202 may move longitudinally forward and rearward on the frame 204. A flywheel 206 is rotatably mounted at the front of the frame 204. The shaft of the flywheel 206 is coupled to an eddy current brake 208.

The eddy current brake 208 functions in a manner similar to that discussed above with respect to the eddy current brake 26 of the bicycle exercise training device. The structure and operation of the eddy current brake 208 may be understood by reference to the discussion of the eddy current brake 26 above.

A user 209 sits on the seat 202 and places his feet on footrests 210 attached to the frame 204. The user grasps a handle 212 that is connected to a cable 214 that is wrapped around a clutch (not shown) connected to the flywheel 206. The structure and operation of an appropriate clutch is well known in the art and would be readily understood by one of ordinary skill in the art.

As the user 209 straightens his legs and pulls upon the handle 212, the clutch causes the flywheel 206 and thus the disk (not shown) of the eddy current brake 208 to rotate. In a manner similar to that discussed above with respect to the eddy current brake 26, this rotation produces a torque/resistance to the rotation of the flywheel 206 and thus motion of the user 209.

In yet other embodiments of the invention, an eddy current brake according to the invention can be used with other types of exercise training devices. For example, an eddy current brake according to the invention could be used with a wheelchair training device. In addition, while the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An exercise training device for use with a bicycle having a rear wheel rotatably mounted on a rear axle, the training device comprising:

a frame for supporting the bicycle in the upright position; and an eddy current brake coupled to the frame to contact the rear wheel of the bicycle when the bicycle is mounted in the frame, the eddy current brake including a nonmagnetic, electrically conductive disk that is rotatably coupled to the rear wheel of the bicycle and one or more magnets positioned to introduce eddy currents in the disk when the disk is rotating, the disk being formed of a copper alloy having between approximately 5.0% to 15.0% zinc by weight.

2. The exercise training device of claim 1, wherein the magnets are electromagnets and wherein eddy currents are introduced in the disk when the disk is rotating and the electromagnets are energized.

3. The exercise training device of claim 1, wherein the disk is formed of a copper alloy having approximately 10.0% zinc by weight.

* * * * *